US011920894B2

(12) United States Patent
Ryder et al.

(10) Patent No.: US 11,920,894 B2
(45) Date of Patent: Mar. 5, 2024

(54) PORTABLE CASE WITH INSERT

(71) Applicant: Kraken Case Company, LLC, Royal Oak, MI (US)

(72) Inventors: Benjamin Thomas Ryder, Royal Oak, MI (US); Steven L. Reff, II, Fowlerville, MI (US)

(73) Assignee: KRAKEN CASE COMPANY, Royal Oak, MI (US)

( * ) Notice: Subject to any disclaimer, the term of this patent is extended or adjusted under 35 U.S.C. 154(b) by 0 days.

(21) Appl. No.: 17/696,134

(22) Filed: Mar. 16, 2022

(65) Prior Publication Data

US 2022/0316840 A1 Oct. 6, 2022

Related U.S. Application Data

(60) Provisional application No. 63/299,462, filed on Jan. 14, 2022, provisional application No. 63/170,380, filed on Apr. 2, 2021.

(51) Int. Cl.
*F41C 33/06* (2006.01)

(52) U.S. Cl.
CPC ..... *F41C 33/06* (2013.01)

(58) Field of Classification Search
CPC ..... A45C 11/38; B65D 2501/24904; F41C 33/06; G01N 2291/251; Y10T 29/49746
USPC ..... 29/428; 33/313, 414, 512, 515, 574; 40/1.5, 299.01, 541, 661.01; 53/54, 55, 53/65, 116, 133.1, 150, 218, 246, 373.4, 53/397, 411, 415, 416, 427, 429, 430, 53/432, 434, 436, 438, 450, 452, 453, 53/455, 456, 459, 467, 469, 470, 472, 53/473, 474, 475, 476, 477, 493, 510, 53/524, 534, 537, 538, 544, 559, 561, 53/574, 111 R; 101/3.1, 21, 27, 29, 31, 101/35, 71, 91, 93, 93.03, 93.05, 93.14, 101/93.35, 111, 112, 114, 115, 123, 126, 101/127, 128.21, 128.4, 129, 163, 170, 101/211, 233, 287, 330, 336, 352.07, 375, 101/376, 378, 395, 401.3, 424.1, 451, 101/463.1, 467, 484, 490, 491, 493,
(Continued)

(56) References Cited

U.S. PATENT DOCUMENTS 2,571,397 A * 10/1951 Wells ..... B29C 39/00 264/226
9,138,084 B1 * 9/2015 Namolovan ..... A47G 9/007
(Continued)

FOREIGN PATENT DOCUMENTS

KR 20160149121 A * 12/2016 ..... A47C 27/148
KR 101782126 B1 * 9/2017 ..... A47C 27/20
(Continued)

OTHER PUBLICATIONS

Memory Foam Pistol Case. GSM Outdoors. Retrieved from: https://www.goutdoorsproducts.com/product/memory-foam-pistol-case/.

*Primary Examiner* — Anthony D Stashick
*Assistant Examiner* — Marcos Javier Rodriguez Molina
(74) *Attorney, Agent, or Firm* — Carlson, Gaskey & Olds, P.C.

(57) ABSTRACT

An insert for a case according to an example of the present disclosure includes, among other things, a first layer comprising a liquid dispersed memory foam, and a second layer disposed on the first layer. Portable cases and methods of forming an insert for a case are also disclosed.

18 Claims, 12 Drawing Sheets

(58) Field of Classification Search
USPC ..... 101/DIG. 36, DIG. 37; 106/1.12, 15.05, 106/18.29, 31.01, 31.13, 31.4, 31.6, 106/31.65, 162.1, 163.01, 222, 243, 270, 106/285, 287.14, 287.26, 400, 481; 116/200, 201, 203, 206, 207, 215, 228, 116/229, DIG. 1; 137/1, 14, 15.08, 137/15.12, 66, 71, 116.5, 312, 315.01, 137/363, 372, 377, 412, 426, 469, 484.8, 137/487.5, 491, 505.11, 505.29, 505.36, 137/505.46, 510, 551, 553, 554, 557, 559, 137/560, 579, 599.01, 602, 625.21, 852, 137/892, 896, 561 R; 206/204, 210, 216, 206/315.2, 316.1, 316.2, 317, 364, 365, 206/366, 367, 370, 459.1, 501, 509, 523, 206/524, 562, 570, 581, 591, 592, 594; 216/10, 12, 13, 17, 18, 20, 23, 24, 32, 33, 216/37, 39, 41, 49, 52, 58, 65, 67, 83, 90, 216/91, 95; 220/4.01, 4.02, 4.12, 6, 9.1, 220/9.4, 17.1, 23.86, 203.01, 305, 324, 220/378, 495.06, 513, 516, 573, 575, 220/592.03, 592.21, 592.25, 603, 605, 220/657, 666, 676, 694, 737, 738, 810, 220/827, 902, 908; 222/23, 59, 61, 64, 222/66, 71, 129.1, 205, 207, 213; 224/148.1, 148.4, 150, 153, 158, 159, 224/160, 161, 162, 181, 191, 192, 197, 224/218, 219, 221, 222, 235, 241, 243, 224/264, 265, 272, 275, 417, 430, 438, 224/439, 463, 483, 539, 545, 546, 554, 224/556, 567, 576, 577, 578, 581, 587, 224/600, 625, 627, 628, 631, 632, 633, 224/642, 643, 644, 660, 911, 930; 248/37.3, 37.6, 49, 74.1, 74.2, 102, 105, 248/118, 118.1, 118.3, 118.5, 125.8, 248/125.9, 127, 146, 148, 155.5, 163.1, 248/176.1, 176.3, 188, 188.2, 188.8, 248/205.1, 216.1, 220.21, 224.7, 237, 248/274.1, 281.11, 282.1, 286.1, 295.11, 248/298.1, 309.1, 310, 311.2, 313, 315, 248/316.5, 316.7, 346.01, 346.03, 346.06, 248/346.3, 351, 354.5, 357, 371, 397, 248/447, 451, 452, 460, 503, 519, 550, 248/619, 677, 918; 264/308, 401; 347/20, 110, 217, 224; 401/49, 55, 68, 401/72, 195; 427/2.1, 2.11, 2.24, 2.25, 427/2.3, 7, 8, 9, 10, 58, 64, 71, 74, 77, 427/79, 96.2, 96.9, 97.2, 97.3, 97.4, 98.4, 427/98.5, 98.6, 99.2, 99.4, 99.5, 102, 115, 427/117, 122, 123, 125, 126.1, 126.2, 427/126.3, 126.4, 131, 136, 137, 142, 427/143, 145, 146, 147, 148, 149, 157, 427/160, 161, 162, 163.2, 164, 165, 176, 427/180, 181, 186, 188, 190, 197, 202, 427/203, 204, 207.1, 208.2, 208.4, 208.6, 427/209, 210, 215, 218, 221, 223, 226, 427/229, 230, 235, 236, 238, 239, 243, 427/248.1, 250, 256, 258, 259, 260, 261, 427/262, 264, 265, 266, 267, 270, 271, 427/272, 275, 277, 278, 279, 280, 282, 427/285, 286, 287, 288, 289, 290, 292, 427/299, 300, 304, 305, 306, 321, 322, 427/327, 329, 331, 333, 335, 346, 355, 427/356, 357, 358, 359, 361, 367, 368, 427/372.2, 373, 374.1, 374.7, 375, 376.1, 427/376.2, 376.3, 376.4, 376.5, 376.7, 427/377, 379, 380, 381, 383.5, 383.7, 427/384, 385.5, 386, 387, 388.1, 388.2, 427/388.3, 388.4, 388.5, 389.7, 389.9, 427/393, 393.5, 393.6, 394, 397.7, 397.8, 427/398.3, 400, 402, 403, 404, 406, 427/407.1, 407.2, 409, 410, 412, 412.1, 427/417, 419.1, 419.2, 419.3, 419.7, 420, 427/421.1, 422, 424, 425, 426, 427, 427/427.2, 427.4, 428.01, 429, 430.1, 427/431, 435, 436, 438, 443.1, 446, 448, 427/455, 469, 475, 484, 487, 496, 498, 427/500, 504, 507, 508, 510, 511, 512, 427/514, 515, 516, 519, 520, 523, 525, 427/528, 531, 532, 535, 537, 540, 541, 427/543, 550, 552, 553, 555, 557, 558, 427/559, 586, 591, 595, 596; 428/1.6, 428/29, 98, 141, 173, 195.1, 199, 204, 428/206, 207, 323, 457; 524/261, 612; 525/50, 55; 156/227, 242, 280; 283/34, 283/56, 67, 70, 72, 74, 81, 83, 85, 86, 91, 283/92, 93, 94, 101, 103, 107, 109, 111, 283/113, 114; D11/130.1, 132, 148, 149; D6/708; D9/520, 537, 538, 540, 541
See application file for complete search history.

(56) References Cited

U.S. PATENT DOCUMENTS

| | | | | |
|---|---|---|---|---|
| 2010/0294675 | A1* | 11/2010 | Mangano | A45C 11/04 206/5 |
| 2013/0193005 | A1* | 8/2013 | Hoeth | G10G 7/005 236/44 C |
| 2020/0191522 | A1* | 6/2020 | Searle | F41C 33/06 |

FOREIGN PATENT DOCUMENTS

| | | | | |
|---|---|---|---|---|
| KR | 102135906 B1 | * | 7/2020 | A47G 9/109 |
| NL | 9101387 A | * | 3/1993 | A45C 11/38 |
| NL | 9101387 A | * | 3/1993 | A45C 13/02 |
| SK | 102135906 B1 | * | 7/2020 | A47G 9/109 |

* cited by examiner

PORTABLE CASE WITH INSERT

CROSS-REFERENCE TO RELATED APPLICATION

This application claims priority to U.S. Provisional Application No. 63/299,462, filed on Jan. 14, 2022, and U.S. Provisional Application No. 63/170,380, filed on Apr. 2, 2021, both of which are incorporated herein in their entirety.

BACKGROUND

The disclosure relates to cases, and more particularly portable cases including one or more inserts for storing and transporting articles.

Portable cases may include one or more inserts situated in a cavity within the case. The insert may be dimensioned to engage an article situated in the cavity. The insert may be pre-formed and trimmed to approximate a surface contour of the article prior to the insert being situated in the cavity.

SUMMARY

A portable case for an article according to an example of the present disclosure includes a case body establishing a cavity, the cavity dimensioned to at least partially receive an article, and an insert comprising a liquid dispersed memory foam received in the cavity.

In a further embodiment of any of the foregoing embodiments, the case body includes a first case portion and a second case portion coupled to the first case portion at a hinge joint, and the first case portion and the second case portion are moveable between an open position and a closed position to enclose the cavity.

In a further embodiment of any of the foregoing embodiments, the case body establishes a groove that follows a perimeter of the first case portion, the groove is dimensioned to receive a seal member that establishes a sealing relationship between the first case portion and the second case portion, and the groove is dimensioned to encircle a wall of the case body establishing the cavity.

A further embodiment of any of the foregoing embodiments includes a handle for carrying the portable case.

In a further embodiment of any of the foregoing embodiments, the article is a firearm.

In a further embodiment of any of the foregoing embodiments, the article is a photography device.

An insert for a portable case according to an example of the present disclosure includes a first layer comprising a liquid dispersed memory foam and a second layer disposed on the first layer, the second layer comprising an elastomeric material.

In a further embodiment of any of the foregoing embodiments, the insert includes one or more surface features along the second layer to establish a graphic. The graphic can establish an external surface of the insert.

In a further embodiment of any of the foregoing embodiments, the one or more surface features include a first surface feature and a second surface feature, the first surface feature is associated with a first color, the second surface feature is associated with a second color that differs from the first color.

A method of forming a portable case according to an example of the present disclosure includes providing a case body that establishes a cavity, the cavity dimensioned to at least partially receive an article, and injecting a quantity of liquid memory foam into the cavity.

In a further embodiment of any of the foregoing embodiments, the method includes curing the quantity of liquid memory foam to establish an insert that substantially conforms to a surface profile of the cavity.

In a further embodiment of any of the foregoing embodiments, the case body includes a first case portion and a second case portion coupled to the first case portion at a hinge joint, and the first case portion and second case portion are moveable between an open position and a closed position to enclose the cavity.

In a further embodiment of any of the foregoing embodiments, the first case portion includes a first recess and the second case portion includes a second recess that cooperate to establish the cavity. The injecting step includes injecting a first portion of the liquid memory foam in the first recess to establish a first insert and injecting a second portion of the liquid memory foam into the second recess to establish a second insert, and the first and second portions are selected such that the article is positioned between the first and second inserts in the closed position.

In a further embodiment of any of the foregoing embodiments, the case body establishes a groove that follows a perimeter of the first case portion, and the groove is dimensioned to encircle a wall of the case body establishing the cavity. The method includes positioning a seal member in the groove. The seal member is dimensioned to establish a sealing relationship between the first case portion and the second case portion in the closed position.

A method of forming an insert for a portable case according to an example of the present disclosure includes providing a containment member that establishes a cavity. The cavity can include a plurality of recesses. The method can include injecting a quantity of a first liquid elastomer into one of the recesses. The method can include injecting a quantity of a second liquid elastomer into another one of the recesses. The method can include injecting a quantity of a third liquid elastomer into the cavity subsequent to the steps of injecting the quantity of the first and second liquid elastomers. The method can include injecting a quantity of liquid memory foam into the cavity subsequent to the step of injecting the quantity of the third liquid elastomer. The method can include curing the quantity of the first and second liquid elastomers to establish respective first and second surfaces feature of the insert, the first and second surface features arranged to establish a graphic. The method can include curing the quantity of the third liquid elastomer. The method can include curing the quantity of the liquid memory foam.

In a further embodiment of any of the foregoing embodiments, the quantity of the first liquid elastomer can be associated with a first color. The quantity of the second liquid elastomer can be associated with a second color that differs from the first color.

In a further embodiment of any of the foregoing embodiments, the method includes removing the insert from the cavity of the containment member subsequent to the step of curing the quantity of the liquid memory foam, and positioning the insert in a case body of the portable case subsequent to the removing step.

In a further embodiment of any of the foregoing embodiments, the case body includes a first case portion and a second case portion coupled to the first case portion at a hinge joint, the first case portion and the second case portion are moveable between an open position and a closed position to enclose a cavity of the case body dimensioned to at least partially receive an article. The positioning step includes situating the insert in the cavity of the case body.

In a further embodiment of any of the foregoing embodiments, the article is a firearm.

In a further embodiment of any of the foregoing embodiments, the method includes establishing geometry along a face of the containment member, the geometry substantially corresponding to an negative of the graphic.

The present disclosure may include any one or more of the individual features disclosed above and/or below alone or in any combination thereof.

The various features and advantages of this disclosure will become apparent to those skilled in the art from the following detailed description. The drawings that accompany the detailed description can be briefly described as follows.

BRIEF DESCRIPTION OF THE DRAWINGS

Like reference numbers and designations in the various drawings indicate like elements.

DETAILED DESCRIPTION

Figure 1:
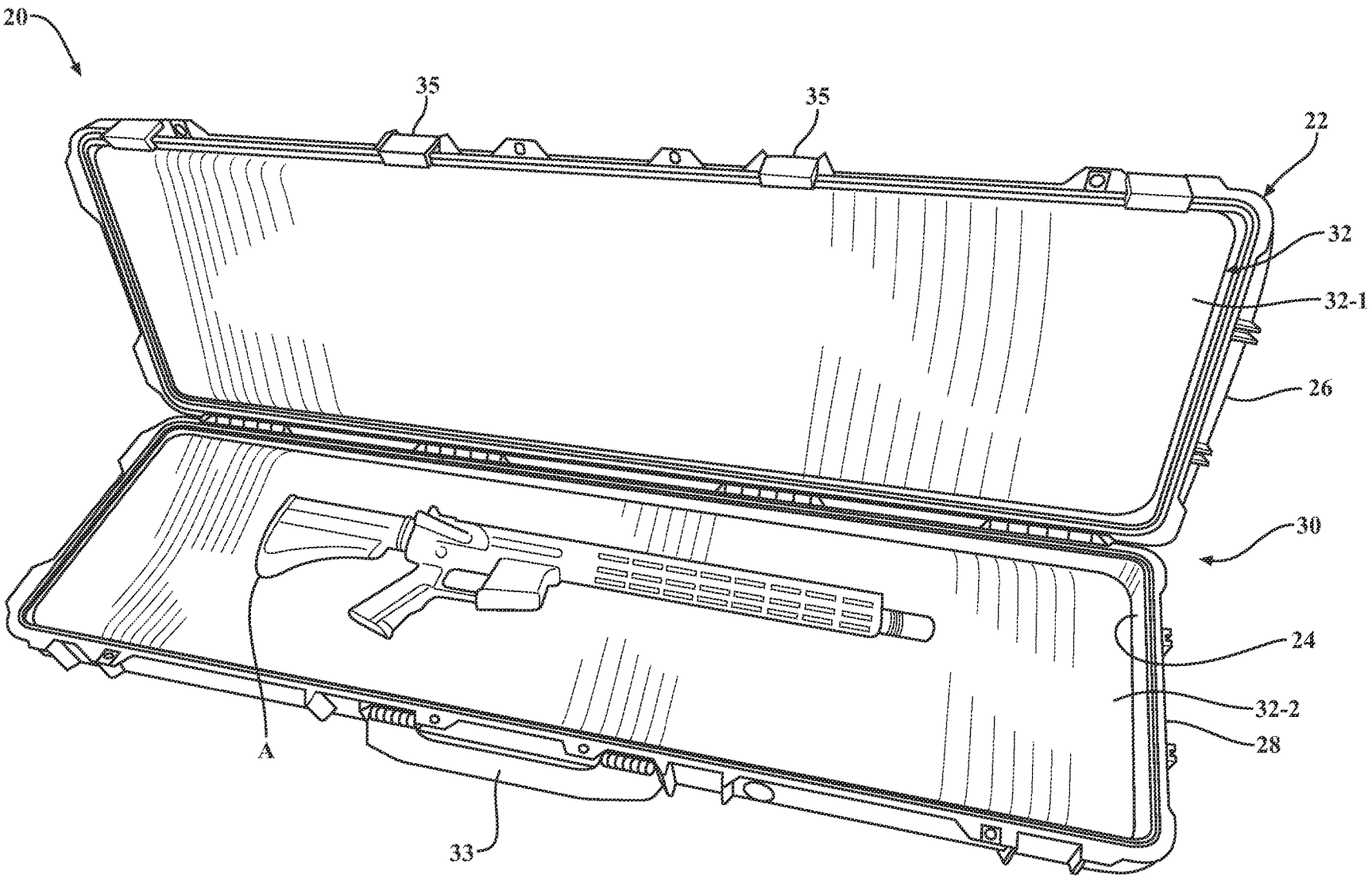
FIG. 1 illustrates a perspective view of an exemplary case in an open position with an article.
Figure 2:
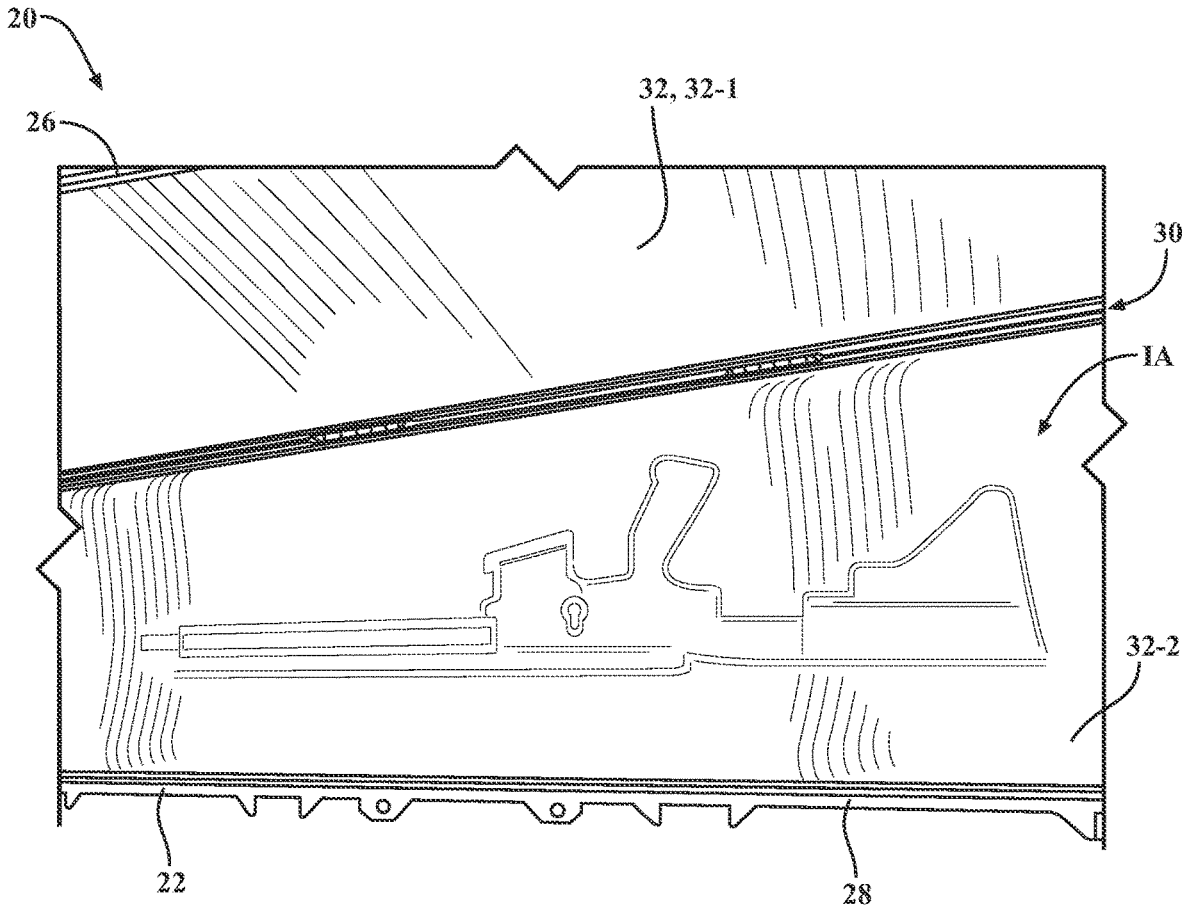
FIG. 2 illustrates a perspective view of the case with the article of FIG. 1 removed.

FIGS. 1-2 illustrate a case 20 according to an example. The case 20 may be a portable case or container utilized to store and/or transport one or more articles. The article may be a firearm, as illustrated by the article A in FIG. 1. Other exemplary articles may include firearm accessories such as sights, magazines, suppressors and ammunition, photography devices such video and photographic cameras and accessories such as camera lenses, batteries and chargers, other articles such as aerial drone devices, medical devices and instrumentation, food, drugs and other medicinal substances including liquids stored in vials or other relatively fragile containers, and/or any other item that may be stored or transported.

Referring to FIG. 1, the case 20 may include a case body 22 establishing at least one cavity 24. The cavity 24 is dimensioned to at least partially receive and enclose one or more articles A. The case 20 may include a first case portion 26 and a second case portion 28. The first and second case portions 26, 28 may be the same or may differ. The first case portion 26 and second case portion 28 may be mechanically attached or otherwise coupled to each other at a hinge connection or joint 30. The first case portion 26 and second case portion 28 are movable between an open position (e.g., FIG. 1) and a closed position (e.g., FIG. 4) to enclose the cavity 24.

The case 20 includes one or more inserts 32 formed or dimensioned to be at least partially received in the cavity 24. Each insert 32 may be configured to directly or indirectly engage one or more articles A situated in the cavity 24. Each insert 32 can at least partially, substantially or completely fill a volume of the cavity 24 to space apart the article(s) A from surfaces of the case body 22 bounding the cavity 24. For the purposes of this disclosure, the terms "substantially," "approximately" and "about" mean±5 percent of the stated value or relationship unless otherwise indicated. The insert 32 establishes an encapsulation environment for securing the article(s) A in the cavity 24 during transport. Each insert 32 may be dimensioned or formed to conform to a surface profile or contour of the article(s) A in an installed position, as illustrated by a respective imprint IA of the article A in FIG. 2, and may be constructed to support and limit or dampen movement of the article(s) A during transport, which may reduce a likelihood of degradation of the article (s) A. The case 20 may include one or more other features, such as a handle 33 for carrying the case 20 and one or more latches 35 to fixedly secure the first and second case portions 26, 28 in the closed position.

Figure 3:
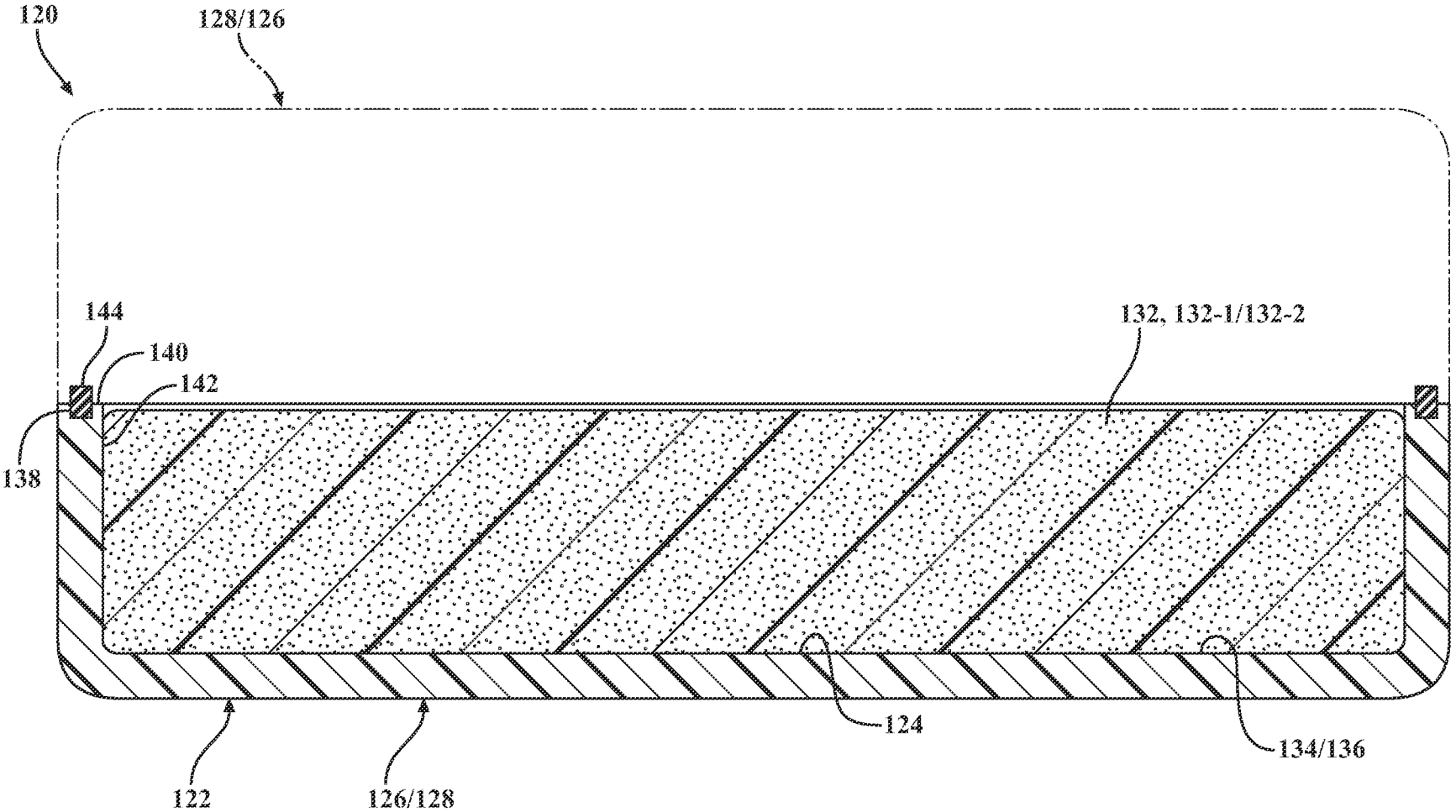
FIG. 3 illustrates a sectional view of a portion of another exemplary case.
Figure 4:
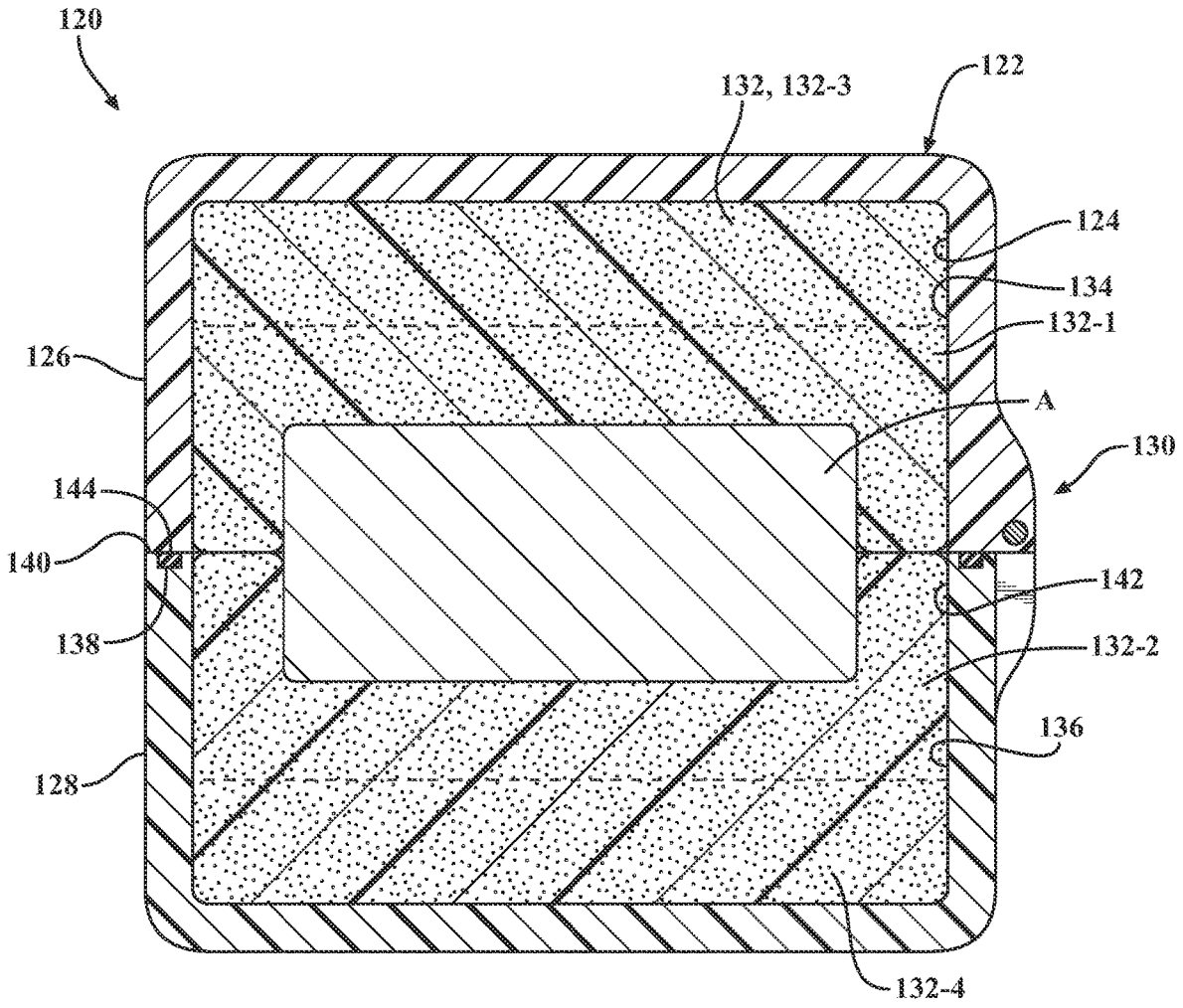
FIG. 4 illustrates a sectional view of the case of FIG. 3 in a closed position and an article situated in the case.

FIGS. 3-4 illustrate another exemplary case 120. In this disclosure, like reference numerals designate like elements where appropriate and reference numerals with the addition of one-hundred or multiples thereof designate modified elements that are understood to incorporate the same features and benefits of the corresponding original elements.

The case 120 may include a case body 122 establishing at least one cavity 124. The cavity 124 is dimensioned to at least partially receive and enclose one or more articles A, as illustrated in FIG. 4. Although only one cavity 124 is illustrated, it should be understood that the case 120 may be constructed to establish any number of cavities 124 each for securing one or more articles A. The case 120 may include a first case portion 126 and a second case portion 128. One of the case portions 126/128 is illustrated in dashed lines in FIG. 3 for illustrative purposes.

The first case portion 126 may include or define a first recess 134. The second case portion 128 may include or define a second recess 136. The first recess 134 and second recess 136 may cooperate to establish different portions of the cavity 124.

The cavity 124 may be dimensioned to receive one or more inserts 132 for securing the article(s) A. For example, the case 120 may include a plurality of inserts 132, as illustrated by first and second inserts 132-1, 132-2 in FIG. 4. Each of the inserts 132-1, 132-2 can be dimensioned to substantially conform to a surface profile of the respective recesses 134, 136 of the cavity 124. A volume of each of the inserts 132-1, 132-2 may be the same or may be different (e.g., less) than a volume of the respective recesses 134, 136. For example, the volume of each of the inserts 132-1, 132-2 may be equal to or greater than 50 percent, or more narrowly equal to or greater than 90 percent, of the volume of the respective recesses 134, 136. Each recess 134, 136 may be dimensioned to receive more than one insert 132 (illustrated by inserts 132-3, 132-4 in dashed lines in FIG. 4 for illustrative purposes). In implementations, a total volume of all of the inserts 132 in the case 120 (e.g., inserts 132-1, 132-2) is greater than a total volume of the cavity 124 such that the inserts 132 are in a partially compressed state in the closed position in response to relative contact or abutment between facing inserts 132.

Various materials may be utilized to form each insert 132. The insert 132 may be formed of a memory foam material such as a liquid dispersed memory or rebounding foam. The memory foam may comprise polyurethane or silicon, for example. The material may undergo a self-curing exothermic reaction to establish the insert 132 subsequent to dispersion. The material may be selected to exhibit various characteristics, including tear and cut resistance, slip resistance, UV resistance, shock absorption, high compression, high rebounding, low weight, water resistance, chemical resistance, and/or characteristics suitable for food and/or drug containment. Polyurethane-based materials may be selected to establish a heat resistance at least as high as about 500 degrees Fahrenheit and/or cold resistance at least as low as about −40 degrees Fahrenheit, for example Silicon-based materials may be selected to establish a heat resistance at least as high as about 500 degrees Fahrenheit and/or cold resistance at least as low as about −80 degrees Fahrenheit, for example. One would understand how to select various liquid dispersed memory foam and other materials to establish these characteristics.

Various techniques may be utilized for situated each insert 132 in the cavity 124. Material forming the insert 132 may be dispersed directly in the cavity 124 or may be formed in a separate mold or containment member and subsequently placed in the cavity 124. The case 120 may include inserts 132 of various dimensions including depths, heights, widths and lengths, and of various materials and densities.

The case body 122 may establish a groove 138 that follows a perimeter 140 of the first case portion 126 (and/or second case portion 128). The groove 138 may be dimensioned to receive at least one seal member 144 that establishes a sealing relationship between the first case portion 126 and second case portion 128 in the closed position, as illustrated in FIG. 4. The groove 138 may be dimensioned to encircle a wall 142 of the case body 122 establishing the cavity 124. A material of the seal member 144 may be the same or may differ from the material of each insert 132. Various materials may be utilized to form the seal member 144, such as an elastomeric material suitable for establishing a sealing relationship.

Figure 5:
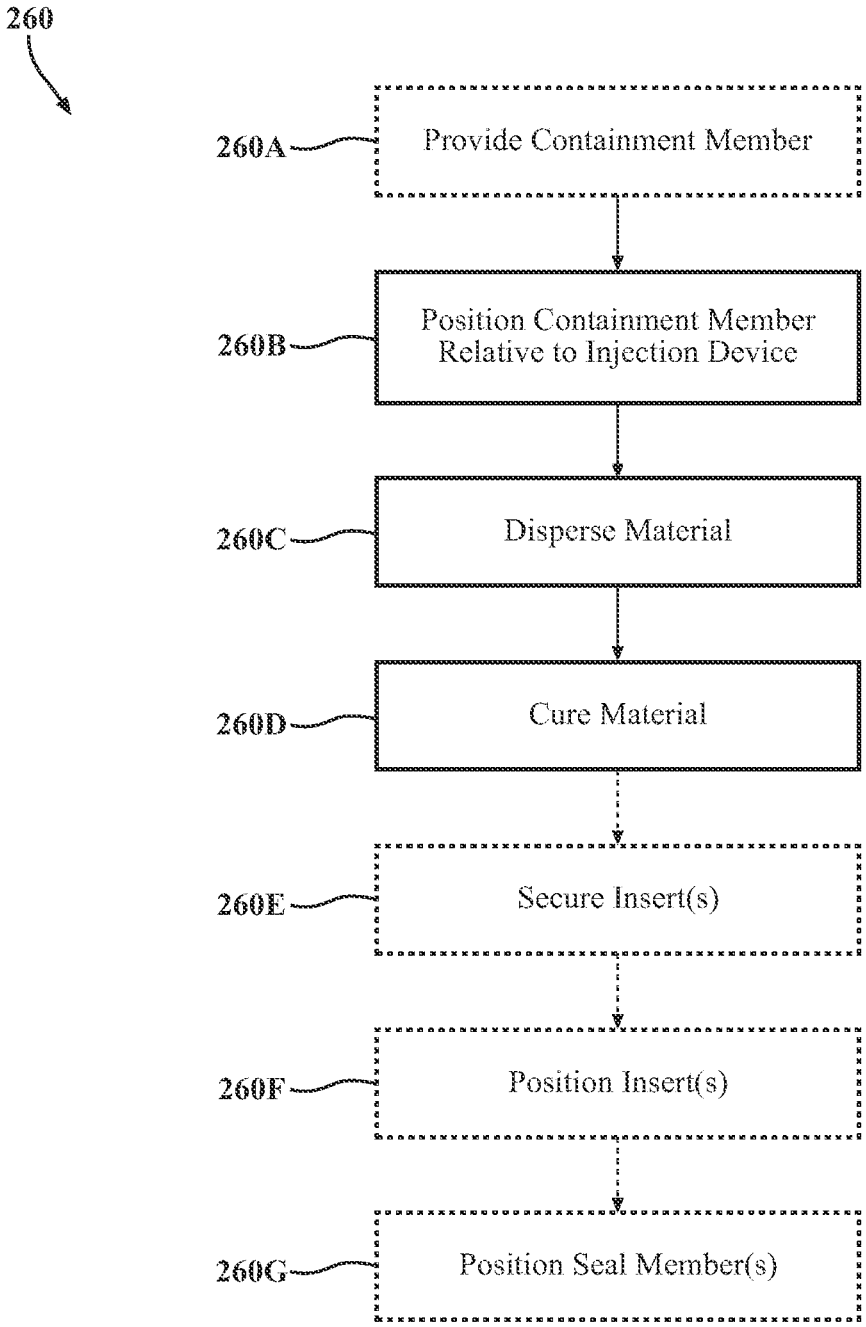
FIG. 5 illustrates a method of forming a case.

FIG. 5 illustrates a method in a flow chart 260 for forming a portable case. The method may be utilized to form any of the portable cases disclosed herein, including the cases 20, 120. The method may utilize one or more foam in place (FIP) techniques to form one or more inserts in a case. Reference is made to exemplary case 220 in FIG. 6 for illustrative purposes. Although the disclosed method primarily refers to forming insert(s) in a relatively hard or rigid case, it should be understood that other cases and articles may benefit from the teachings disclosed herein, including deformable articles such as soft cases and backpacks.

Figure 6:
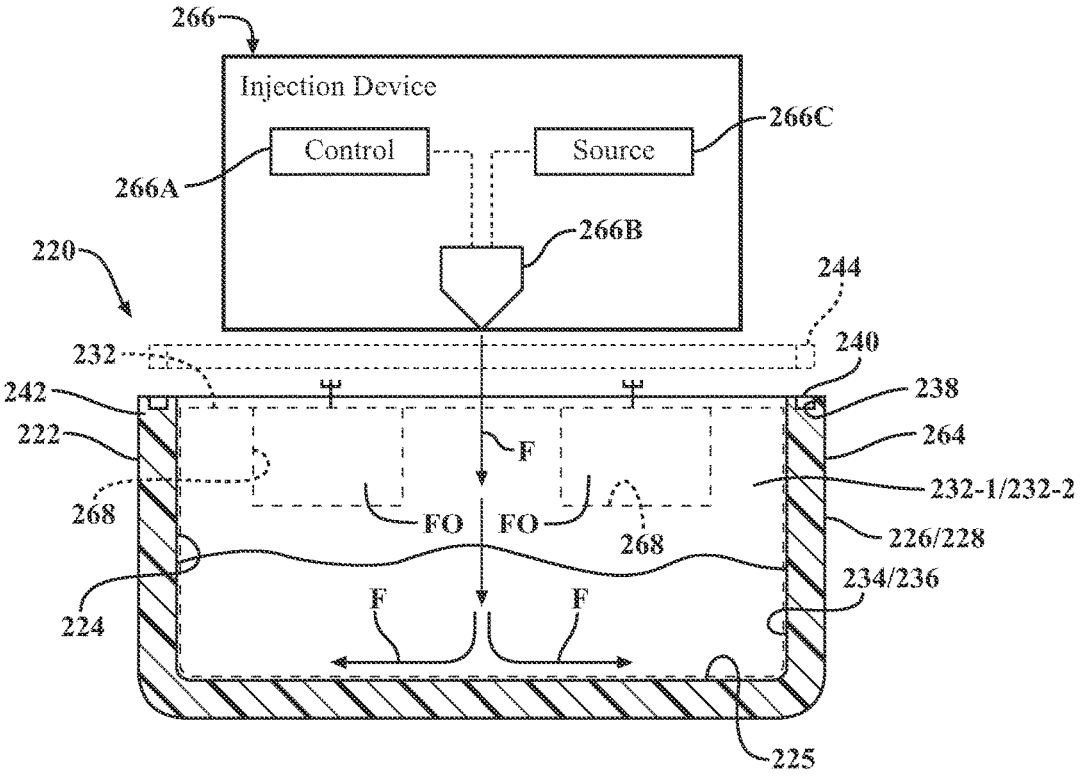
FIG. 6 illustrates a containment member positioned relative to an injection device.

Referring to FIG. 6, with continuing reference to FIG. 5, a containment member 264 is provided at step 260A. The containment member 264 may be a portion of, or establish, a case body 222. The containment member 264 may establish or substantially approximate at least a portion of a cavity 224, such as one of the recesses 134, 136 of FIG. 4. In implementations, the containment member 264 may be a mold having a profile that substantially approximates a profile of the cavity 224. The case body 222 may be formed of any of the materials disclosed herein. The cavity 224 can be dimensioned to at least partially receive and secure one or more articles such as the article A of FIGS. 1 and 4. The case body 222 may be a relatively rigid material or may be a soft shell or textile material. For example, the case body 222 may be molded from a polymer material such as polypropylene.

At step 260B, the containment member 264 can be positioned relative to an injection device 266. The injection device 266 may include a control 266A coupled to a dispersion member or injector 266B. The injector 266B may be coupled to a material source 266C, such as a liquid material. The control 266A may be configured to cause the injector 266B to eject, pour or otherwise disperse a quantity of material from the material source 266C into the cavity 224 in response to one or more commands.

The control 266A may include a processor, a memory and an interface. The processor may, for example only, be any type of known microprocessor having desired performance characteristics. The memory may, for example only, includes UVPROM, EEPROM, FLASH, RAM, ROM, DVD, CD, a hard drive, or other computer readable medium which may store data and logic for executing the method as described herein. One would understand how to program the control 266A with logic to cause the injector 266B to disperse the material.

At step 260C, the control 266A can cause the injector 266B to eject, pour or otherwise disperse material into the cavity 224, including any of the materials disclosed herein. Step 260C may include injecting a quantity of liquid or fluid F into the cavity 224 from the material source 266C. The quantity of liquid or fluid F may include any of the quantities and associated insert volumes disclosed herein. The dispersed liquid or material may include any of the materials disclosed herein such as a liquid dispersed memory foam configured to flow throughout a volume of the cavity 224 to substantially conform to a surface contour of the cavity 224.

Figure 7:
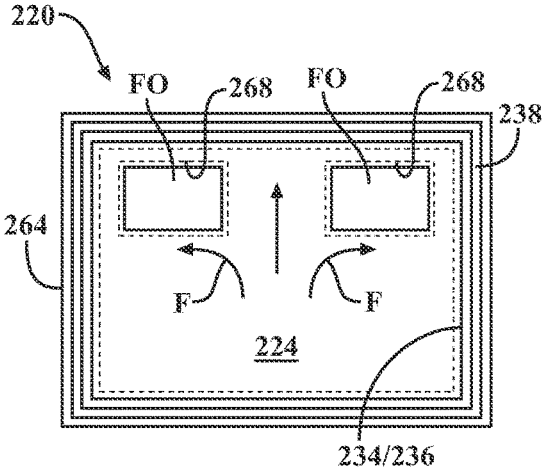
FIG. 7 illustrates forming objects situated in a cavity of a containment member.
Figure 8:
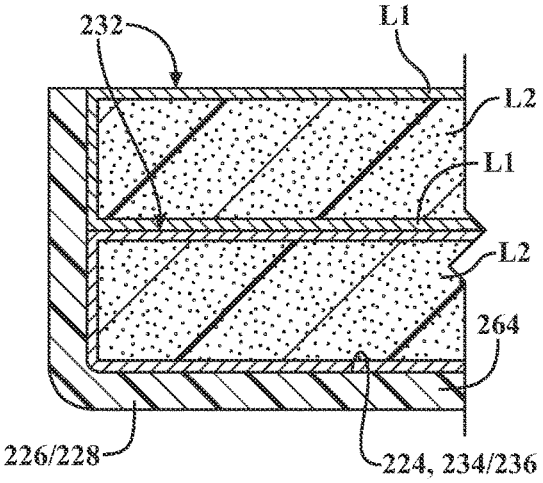
FIG. 8 illustrates a sectional view of an exemplary insert arrangement.

One or more forming objects FO may be situated in the cavity 224 of the containment member 264 prior to step 260C, as illustrated in FIGS. 7-8. Each forming object FO may be situated in the cavity 224 to establish a respective void or recess 268 in the resultant insert 232. In implementations, the forming objects FO may be suspended from or otherwise coupled to a static structure such that the forming objects FO are spaced apart from a floor 225 of the cavity 224, as illustrated in FIG. 6. The material or fluid F flows around a perimeter of the forming objects FO to establish the respective recesses 268. In other implementations the forming objects FO are omitted. The recesses 268 may be dimensioned to at least partially receive one or more articles, including any of the articles disclosed herein such as one or more accessories. Each forming object FO may be dimensioned to substantially approximate a profile of the respective article.

At step 260D, the dispersed material may be cured to establish at least one insert 232. The dispersed material may undergo a self-curing exothermic reaction during step 260D. The insert 232 may be formed of one or more layers having different densities or other characteristics. For example, the self-curing may establish an external surface or layer L1 having a relatively higher density than an internal portion or layer L2 of the resultant insert 232, as illustrated in FIG. 8. The layers L1, L2 may have the same composition but may have different firmness and rebound characteristics associated with the respective densities. In the illustrative example of FIG. 8, one insert 232 may be formed in the cavity 224 and another insert 232 formed by a previous iteration of the method 260 may be positioned in stacked relationship with the insert 232 to establish a multi-layer arrangement in the respective recess 234/236 (see also FIGS. 9-10). One or more articles may be situated between the facing inserts 232 during usage. Each insert 232 may substantially conform to a surface profile or contour of the cavity 224. The resultant insert 232 is shown in dashed lines in FIG. 6 for illustrative purposes.

Steps 260C-260D may include injecting a first portion of the liquid or fluid F in a first recess 234 to establish a first insert 232-1 and injecting a second portion of the fluid F into a second recess 236 to establish a second insert 232-2, as illustrated by the inserts 132-1, 132-2 of FIG. 4. The controller 266A can be configured to select a suitable quantity of the material or fluid F such that the selected article(s) are trapped or otherwise positioned between the first and second inserts 232-1, 232-2 in a closed position, as illustrated by the article A and inserts 132-1, 132-2 of FIG. 4.

The case body 222 may establish at least one groove 238 that follows a perimeter 240 of the first case portion 226 (and/or second case portion 228). The groove 238 can be dimensioned to encircle a wall 242 of the case body 222 establishing the cavity 224.

At step 260E, one or more resultant inserts 232 may be attached or otherwise secured in the respective recesses 234, 236. Various techniques may be utilized to secure each insert 232. Step 260E may include bonding surfaces of the respective insert 232 and surfaces of the respective recess 234, 236 with an adhesive. Step 260E may include heat treating the case body 222 including the first and/or second case portions 226, 228 with one or more of the inserts 232 to cause the insert(s) 232 to adhere to the surfaces of the first and/or second case portions 226, 228 establishing the respective recesses 234, 236. In other implementations, the inserts 232 are unadhered to the case body 222 such that the inserts 232 are removable from the case 220.

At step 260F, one or more additional (e.g., floating) inserts 232 may be positioned in the respective recesses 234, 236. Each additional insert 232 may be formed utilizing any of the techniques disclosed herein. In implementations, each additional insert 232 may be formed in a containment member 264 that is dimensioned to substantially approximately a surface profile of the respective recess 234, 236 at the respective elevation of the additional insert 232 when positioned in stacked relationship with one or more other inserts 232 formed in the respective recess 234, 236, as illustrated by the inserts 232 of FIG. 8 and the inserts 332-2, 332-3 of FIGS. 9-10. The additional insert(s) 232 may be positioned subsequent to the securing step 260E such that the additional insert(s) 232 are floating or removable from the cavity 224.

At step 260G, a seal member 244 may be positioned in the groove 238 (shown in dash lines for illustrated purposes, see also FIG. 1). The seal member 244 can be dimensioned to establish a sealing relationship between the first case portion 226 and second case portion 228 in the closed position, as illustrated by the case 120 of FIG. 4.

Figure 9:
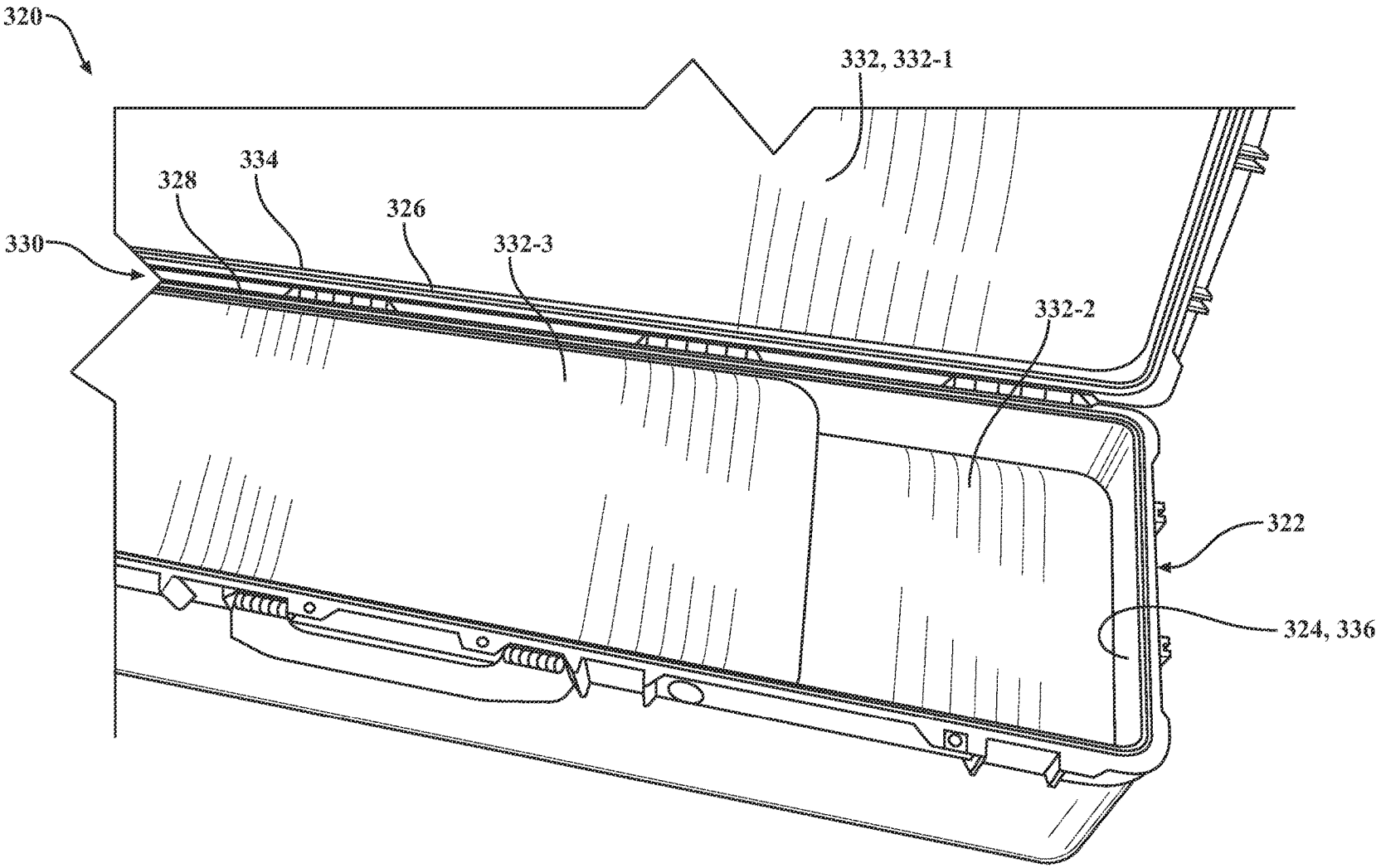
FIG. 9 illustrates another exemplary case in an open position.
Figure 10:
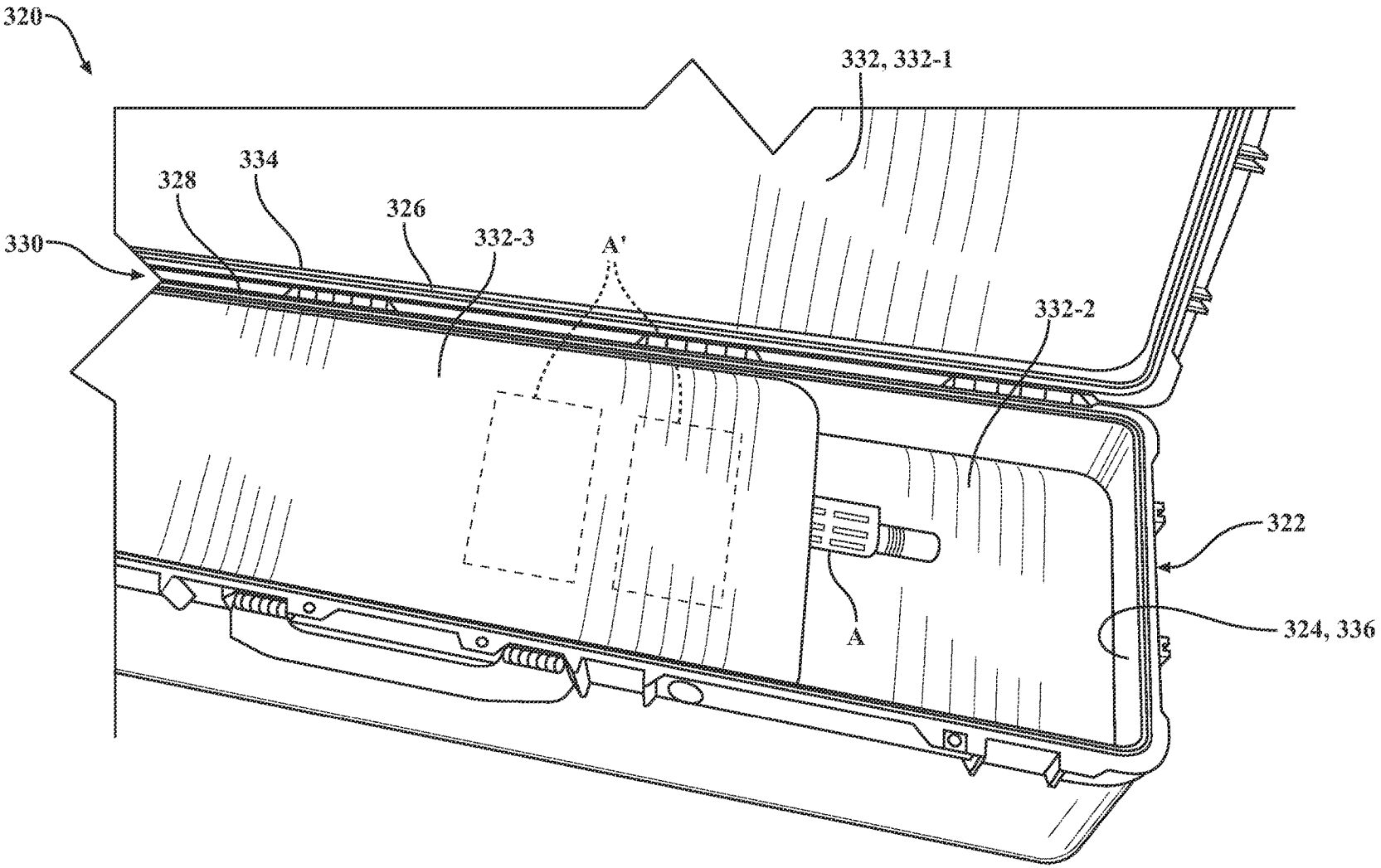
FIG. 10 illustrates a perspective view of the case of FIG. 9 with an article.

FIGS. 9-10 illustrate another exemplary case 320. The case 320 may include a case body 322 establishing at least one cavity 324. The cavity 324 is dimensioned to at least partially receive and enclose one or more articles A, as illustrated in FIG. 10. The case 320 may include a first case portion 326 and a second case portion 328 coupled at a hinge connection 330. The first case portion 326 may include or define a first recess 334. The second case portion 328 may include or define a second recess 336. The first recess 334 and second recess 336 may cooperate to establish different portions of the cavity 324.

The case 320 may include one or more inserts 332 formed or dimensioned to be at least partially received in the cavity 324, as illustrated by first, second and third inserts 332-1, 332-2, 332-3. Each insert 332 may be configured to directly or indirectly engage one or more articles A situated in the cavity 324. Each of the inserts 332-1, 332-2, 332-3 can be dimensioned to substantially conform to a surface profile of the respective recesses 334, 336 of the cavity 324 at the respective elevation or position in the case 320.

At least one of the recesses 334, 336 may be dimensioned to receive a plurality of inserts 332, as illustrated by inserts 332-2, 332-3 situated in the recess 336. Insert 332-3 is shown in a partially installed position for illustrative purposes. The inserts 332-2, 332-3 may be placed in stacked relationship in the recess 336. The insert 332-3 may be removable from the recess 336 to facilitate positioning of the article(s) A between the inserts 332-2, 333-3, as illustrated in FIG. 10. One or more articles A may be trapped or otherwise positioned between the inserts 332-2, 332-3, and one or more other articles A' may be trapped or otherwise positioned between the inserts 332-1, 333-3 in the closed position to establish separate storage compartments or regions within the case 320 (A' indicated in dashed lines in FIG. 10 for illustrative purposes).

In implementations, a total volume of all of the inserts 332 in the case 320 (e.g., inserts 332-1, 332-2, 332-3) is greater than a total volume of the cavity 324 such that the inserts 332 are in a partially compressed state in the closed position in response to relative contact or abutment between facing inserts 332 (e.g., 332-1, 332-3). A combined volume of the inserts 332-3, 332-3 may be greater than a volume of the recess 336, such as approximately 101 percent or more of volume of the recess 336 (see, e.g., inserts 232 of FIG. 8). A volume of the insert 333-1 may be approximately equal to a volume of the recess 334 such that the insert 332-1 is substantially flush with a lip of the first case portion 326.

Figure 11:
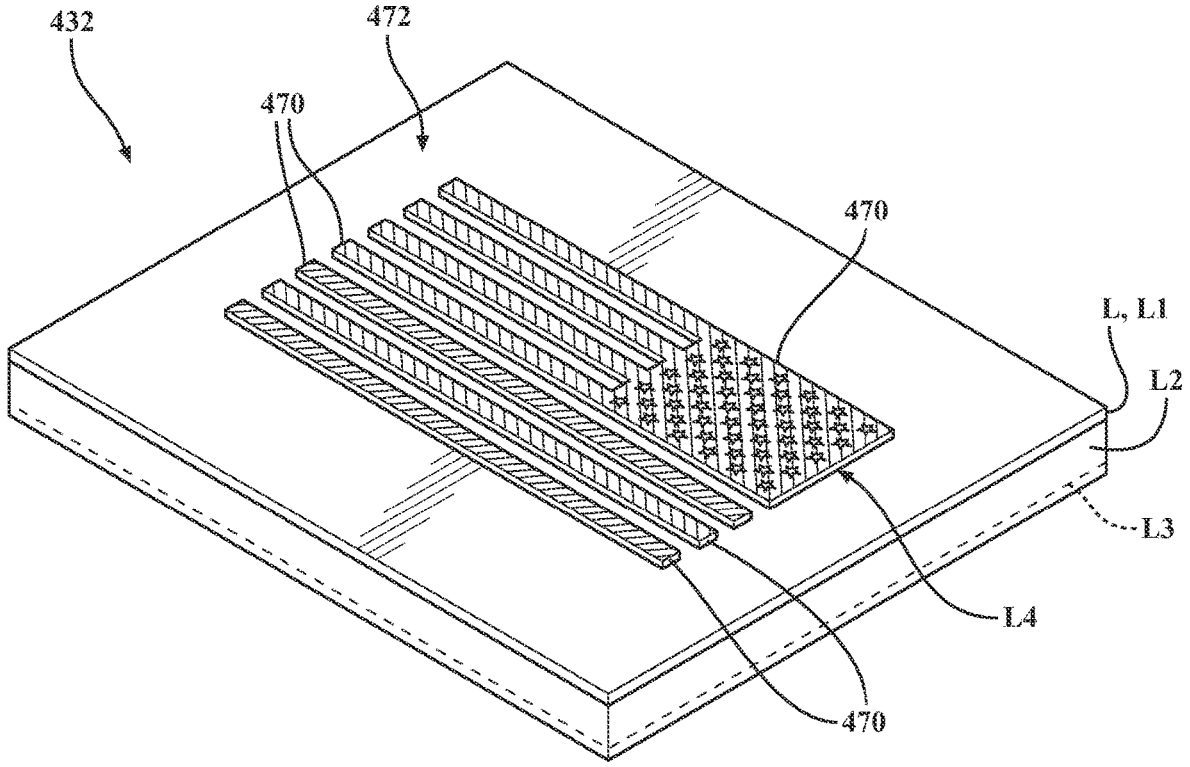
FIG. 11 illustrates another exemplary insert including one or more surface features.

FIG. 11 illustrates another exemplary insert 432. The insert 432 can be utilized in any of the arrangements disclosed herein, including any of the cases 20, 120, 220, 320. The insert 432 may be formed or dimensioned to be at least partially received in a cavity of a case, such as one of the cavities 24, 124, 224, 324. The insert 432 may be configured to directly or indirectly engage one or more articles situated in the respective cavity. The insert 432 can be dimensioned to substantially conform to a surface profile of the recess of the respective cavity 24, 124, 224, 324 at the respective elevation or position in the case 20, 120, 220, 320, such as one of the recesses 134, 234, 334.

The insert 432 may be formed of, or otherwise established by, one or more layers L of material having the same or different characteristics, including any of the characteristics disclosed herein. The layers L can include a first layer L1 and a second layer L2. The first layer L1 can be disposed along the second layer L2. The first layer L1 can establish a first skin of the insert 432. In implementations, the layers L can include a third layer L3 (shown in dashed lines for illustrative purposes). The third layer L3 can be disposed along the second layer L2 and can establish a second skin of the insert 432. The first layer L1 and third layer L3 can be disposed on opposite sides of the second layer L2. In implementations, one or more of the layers L may be omitted, such as the third layer L3.

The layers L of the insert 432 can include a fourth layer L4. The fourth layer L4 can be disposed along one of the layers L, such as the first layer L1. The fourth layer L4 can be disposed a face of the insert 432 to establish an external surface of the insert 432. The first layer L1 and fourth layer L4 can cooperate to establish the first skin. In implementations, the first layer L1 and fourth layer L4 establish different regions of a single, contiguous layer L of the insert 432. In other implementations, the first and fourth layers L1, L4 are separate and distinct layers L of the insert 432.

Various materials may be utilized to form the insert 432, including each of the layers L. The layers L can be formed utilizing any of the materials disclosed herein. In implementations, the second layer L2 can be formed of a memory foam material such as a liquid dispersed memory or rebounding foam. The first, third and/or fourth layers L1, L3, L4 can be formed of an elastomeric material, including a liquid dispersed elastomer such as a polyurethane.

The insert 432 can include one or more surface features 470. The surface features 470 may be arranged along one or more faces of the insert 432 to establish a graphic 472. The surface features 470 can be contiguous or can be spaced apart from each other to establish the respective graphic 472. The graphic 472 can be arranged or established along an external surface or face of the insert 432 such that the graphic 472 is visible to the user in an assembled, open position of the respective case or container. Although only one graphic 472 is shown, it should be understood that the insert 432 can be formed with any number of graphics. The graphic 472 can be established by two or more surface features 470 having colors and/or shades that differ from each other, as illustrated by hatching in FIG. 11. In other implementations, the graphic 472 can be established by surface features 470 having colors and/or shades that are substantially the same as each other such that the graphic 472 has a substantially uniform color or shade.

The graphic 472 can be established to depict various geometries, including various words, logos, shapes, images, symbols, etc. In the illustrative example of FIG. 11, the graphic 472 depicts an American flag established by the surface features 470. The surface features 470 can be associated with one or more stars and stripes. It should be understood that a geometry of the graphic 472 of FIG. 11 is exemplary, and different geometries can be utilized in accordance with the teachings disclosed herein. In other implementations, the insert 432 is free of any graphics.

Various techniques can be utilized to form the insert 432, including any of the techniques disclosed herein. In implementations, the insert 432 is formed in the case 220 of FIG. 6 utilizing the injection device 266. In other implementations, the insert 432 can be formed in a mold utilizing an open mold or closed mold process.

Figure 12:
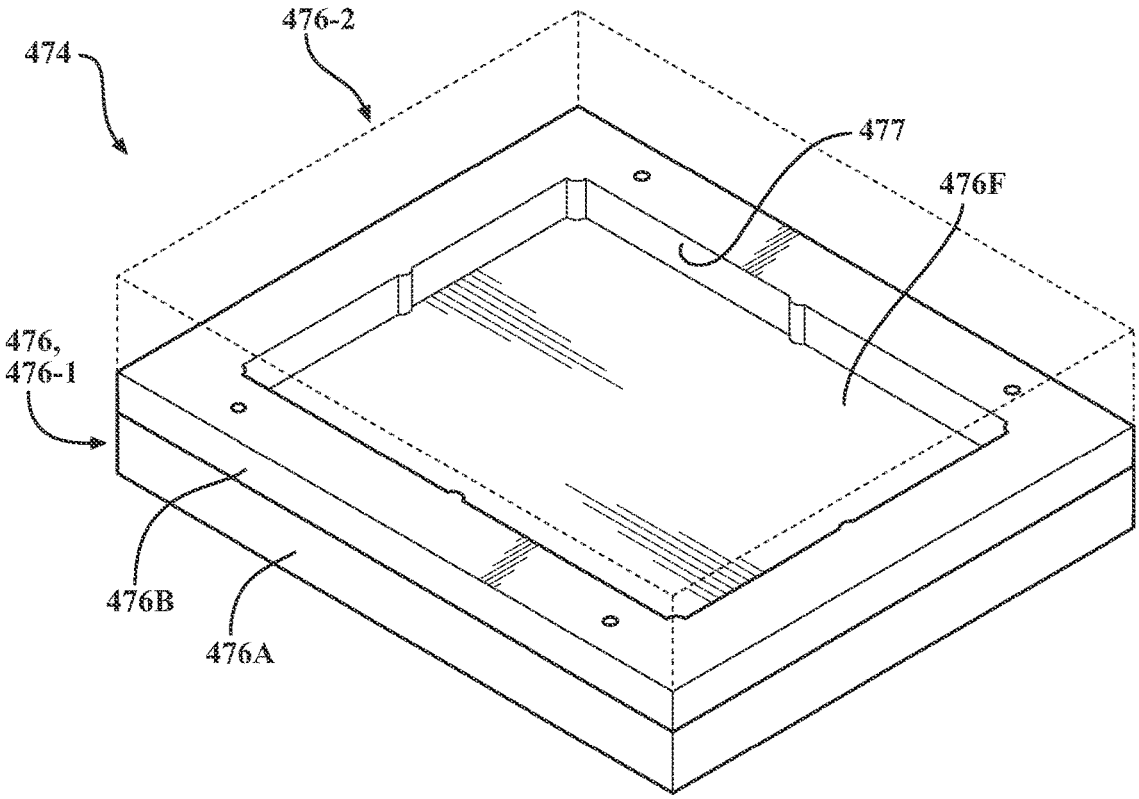
FIG. 12 illustrates an exemplary mold assembly.

FIG. 12 illustrates an exemplary mold assembly 474. The mold assembly 474 can be utilized to form the insert 432 of FIG. 11. The mold assembly 474 includes one or more molds 476. In the implementation of FIG. 12, the mold assembly 474 includes a first mold 476-1 and a second mold 476-2 (shown in dashed lines for illustrative purposes). The first and second molds 476-1, 476-2 can be arranged in abutment to establish a closed mold arrangement. The assembly 474 includes a cavity 477 dimensioned to receive material, including any of the materials herein, to establish a respective insert. The cavity 477 can be dimensioned utilizing any of the techniques disclosed herein and can be associated with any of the cavities 24, 124, 224, 324. The cavity 477 can be dimensioned to form one or more inserts, such as the insert 432 of FIG. 11.

The mold 476 can include a first (e.g., base) portion 476A and a second (e.g., wall) portion 476B. The first and second portions 476A, 476B can cooperate to establish surfaces of the cavity 477. The first and second portions 476A, 476B can be integrally formed or can be separate and distinct components mechanically attached or otherwise secured to each other.

Geometry can be formed along one or more faces of the mold 476, such as along a face 476F of the first portion 476A of the mold 476. In the illustrative example of FIG. 13, mold 576 includes a first portion 576A. Geometry 576G can be established along a face 576F of the first portion 576A of the mold 576. The geometry 576G can substantially correspond to an inverse or negative of the graphic 472 of the insert 432 of FIG. 11, for example. The geometry 576G can be established by one or more recesses 578 in the face 576F of the mold 576. Each recess 578 can be dimensioned to establish, or can otherwise be associated with, a respective one of the surface features 470 of the insert 432 of FIG. 11. Various techniques can be utilized to form each mold 476, 576 and the associated geometry 576G, including casting, machining, three-dimensional printing and other rapid prototyping techniques.

Figure 14:
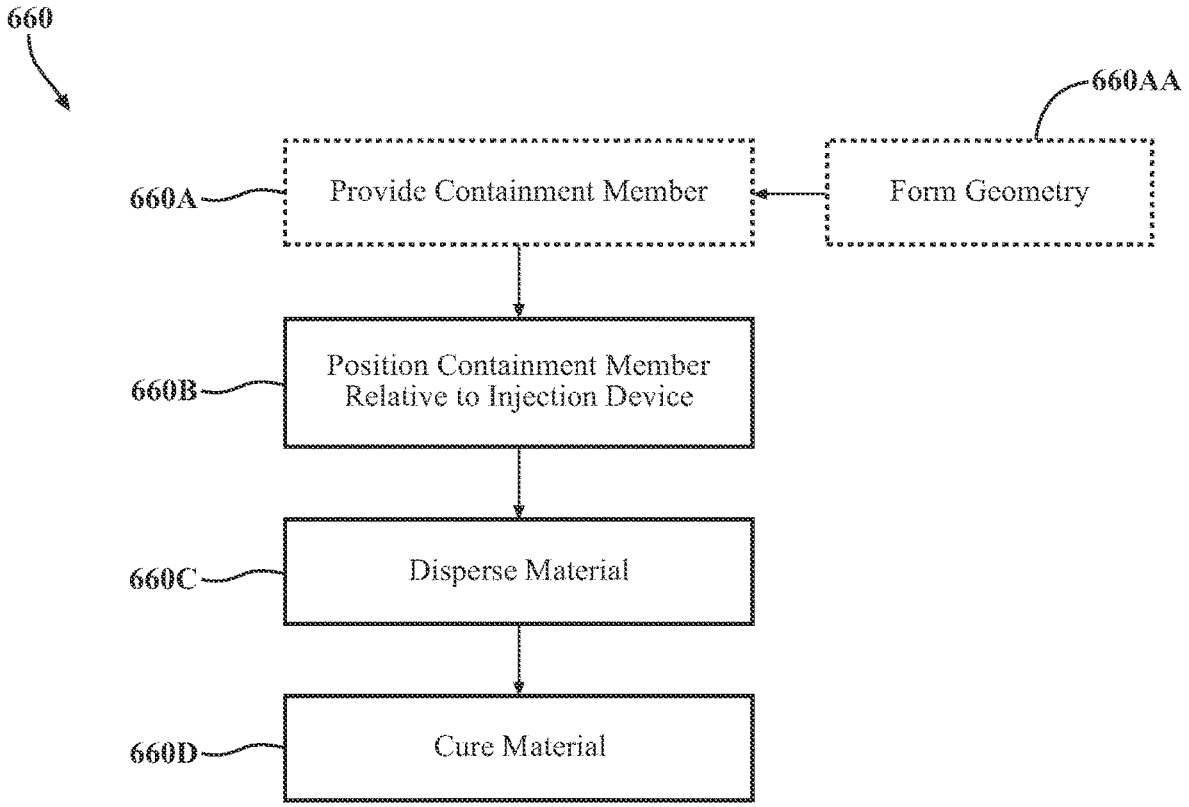
FIG. 14 illustrates a method of forming an insert.

FIG. 14 illustrates a method in a flowchart 660 of forming an insert for a portable case or other container dimensioned to receive one or more articles. The method 660 may be utilized to form any of the portable cases and containers disclosed herein, including the cases 20, 120, 220. Method 660 can incorporate any of the steps of the method 260 of FIG. 5 and can be utilized with any of the features of the injection device 266 of FIG. 6. The method 660 may utilize one or more open mold or closed mold techniques to form one or more inserts, including any of the inserts disclosed herein. An exemplary resultant insert 632 and associated layers L are shown in dashed lines in FIG. 15 for illustrative purposes.

Figure 15:
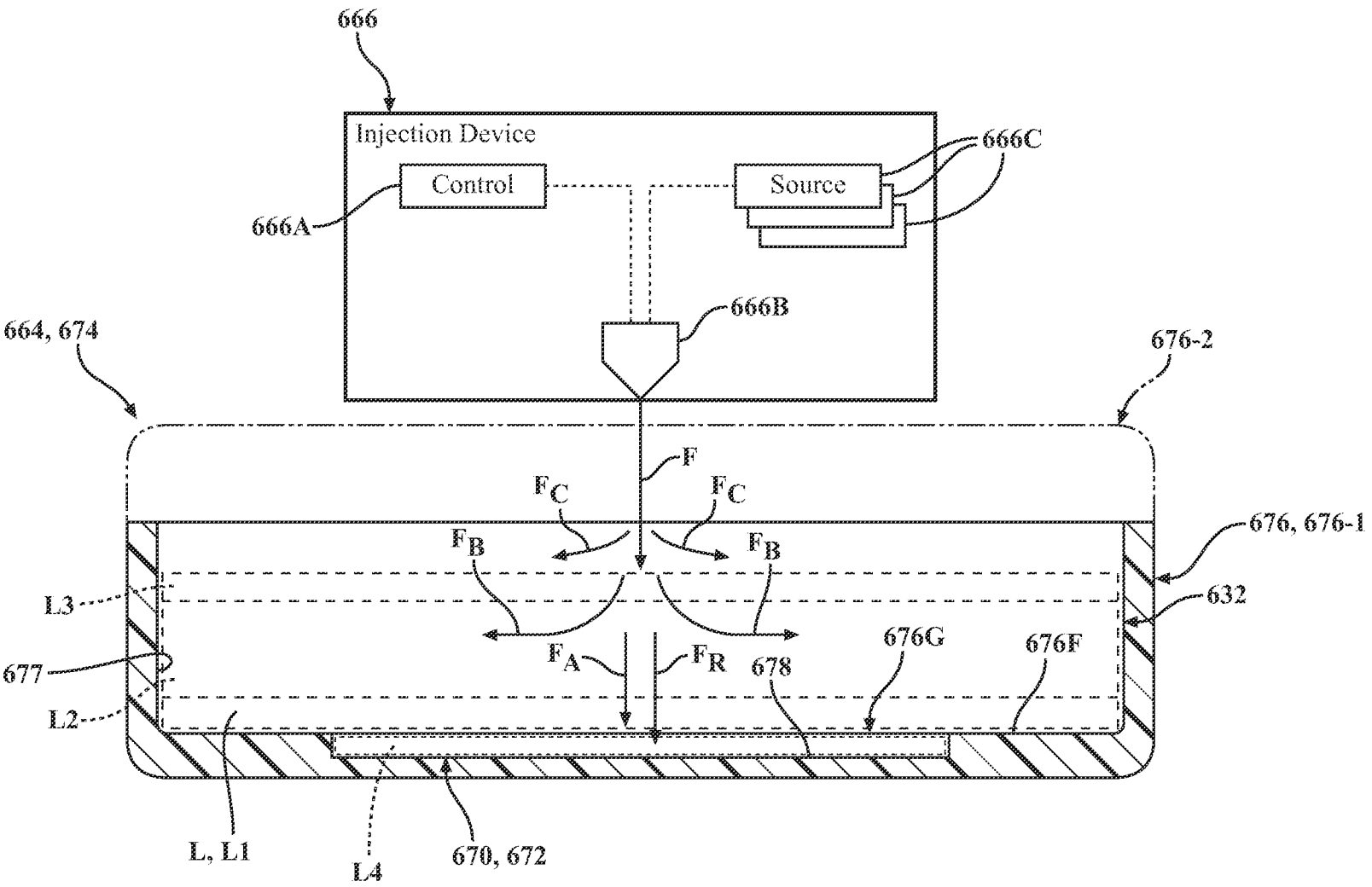
FIG. 15 illustrates a containment member positioned relative to an injection device.

Referring to FIG. 15, with continuing reference to FIG. 14, a containment member 664 is provided at step 260A. The containment member 664 can be established by a mold assembly 674. In other implementations, the containment member 664 may be a portion of, or establish, a portable case. The containment member 664 may establish a cavity 677. The mold assembly 674 can include one or more molds 676. One or more of the mold 676 can have a profile that substantially corresponds to a profile of the insert 432 or one of the cavities 24, 124, 224 of the cases 20, 120, 220 and/or associated inserts.

Step 660A can include forming geometry 676G in the containment member 664 at step 660AA. The geometry 676G can include any of the geometry disclosed herein, such as the geometry 576G of FIG. 13. The geometry 676G can be established by one or more recesses 678 in a face 676F of the respective mold 676 (one recess 678 shown in FIG. 15 for illustrative purposes, see also recesses 578 of FIG. 13). The geometry 676G can be established utilizing any of the techniques disclosed herein.

At step 660B, the containment member 664 can be positioned relative to an injection device 666. The injection device 666 can include a control 666A coupled to a dispersion member or injector 666B. The injector 666B can be coupled to one or more material sources 666C. Each material source 666C can be configured to supply a quantity of material, including any of the materials disclosed herein. The material sources 666C can be configured to supply a respective quantity of the same or different materials. For example, one of the material sources 666C can provide a liquid dispersed memory foam and other material source(s) 666C can provide a liquid elastomeric material having the same or different pigments to establish respective colors and/or shades. The pigments of the respective materials can establish associated colors and/or shades that are visually distinct from each other.

The control 666A can be configured to cause the injector 666B to eject, pour or otherwise disperse a quantity of material from each of the material sources 666C into localized regions of the cavity 677 in response to one or more commands. At step 660C, the control 666A can cause the injector 666B to eject, pour or otherwise disperse material into the cavity 677, including any of the materials disclosed herein. Step 660C may include injecting a quantity of liquid or fluid F into the cavity 677 from one or more of the material sources 666C. The quantity of liquid or fluid F may include any of the quantities and associated insert volumes disclosed herein. The dispersed liquid or material may include any of the materials disclosed herein such as a liquid dispersed memory foam and/or elastomer configured to flow throughout a volume of the respective regions of the cavity 677 to substantially conform to a surface contour of the cavity 677.

Figure 13:
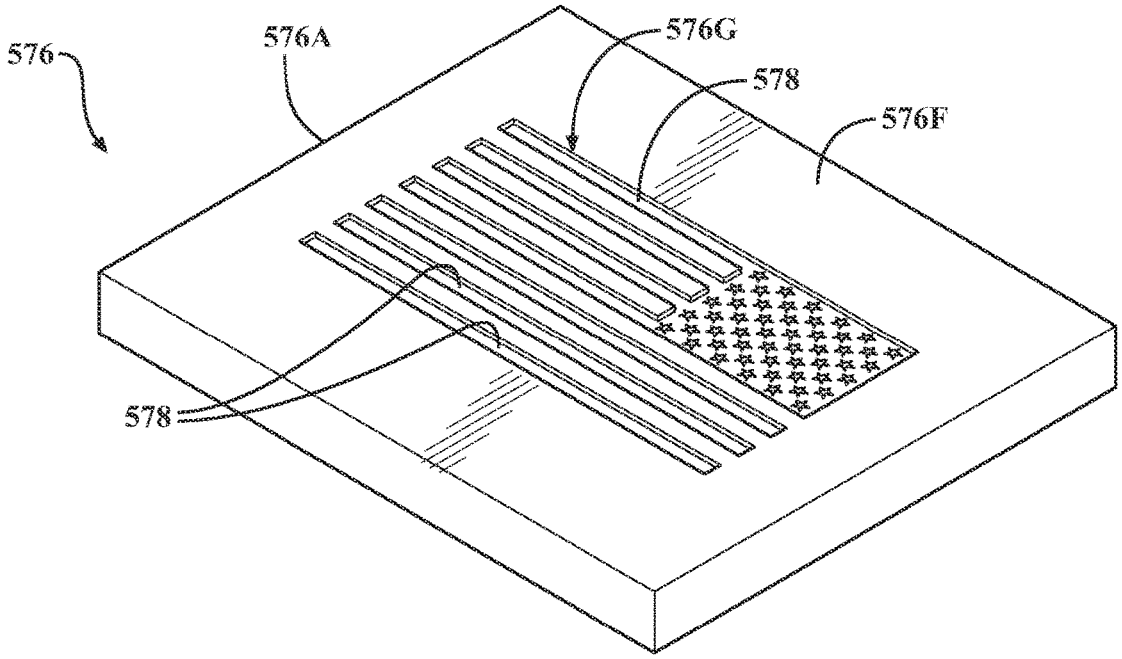
FIG. 13 illustrates an exemplary mold of the mold assembly of FIG. 12.

Step 660C can include dispersing material or fluid $F_R$ from one or more of the material sources 666C into one or more respective recesses 678 (see also recesses 578 of FIG. 13). Step 660C can occur such that a graphic 672 of the resultant insert 632 is established by surfaces features 670 having the same or different colors and/or shades. The graphic 672 can be established along a layer L4 of the insert 632.

Step 660C can include dispersing material or fluid $F_A$ from one the material sources 666C in the cavity 677 subsequent to dispersing the respective materials or fluids $F_R$ into the recesses 678. The material or fluid $F_A$ can establish a layer L1 of the insert 632.

Step 660C can include dispersing another material or fluid $F_B$ from another one the material sources 666C in the cavity 677 to establish one or more additional layers L, such as the layer L2. The material can be a liquid dispersed memory foam. Step 660C can include dispersing another material or fluid $F_C$ from one the material sources 666C in the cavity 677 to establish a layer L3. The fluid $F_R$ for each respective recess 678, the fluid $F_A$, the fluid $F_B$, and/or the fluid $F_C$ can be dispersed sequentially in the cavity 677. Step 660C can include at least partially curing the layer L4 and/or together with the layer L1 prior to dispersing the fluid $F_B$ and or fluid $F_C$ associated with the respective layers L2, L3. In implementations, the layer L3 can be omitted. The mold 676-2 can be positioned in abutment with the mold 676-1 of the mold assembly 674 to substantially or completely enclose the cavity 677 subsequent to dispersing the materials in step 660C.

At step 660D, the dispersed materials or fluids $F_R$, $F_A$, $F_B$, and $F_C$ may be cured to establish at least one insert 632. The dispersed materials or fluids $F_R$, $F_A$, $F_B$, and $F_C$ may undergo a self-curing exothermic reaction during step 660D. The insert 632 may be formed of one or more layers L having the same or different characteristics, including any of the characteristics disclosed herein. The layers L1, L4, including the portions of the layer L4 associated with the surface features 670, may have the same composition but may have the same or different pigments associated with respective colors or shades to establish the respective graphic 676G.

The disclosed techniques of forming the inserts and associated cases may reduce tooling time by eliminating the need for separate dies. The inserts may be formed of a memory foam material, which may substantially conform to a surface profile of articles situated in the case and which may accommodate articles of various shapes and sizes without the need for cutting or trimming the inserts to conform to particular articles. The disclosed techniques may be utilized to form a pattern along a surface of the insert, which can be associated with various color schemes.

Although the different examples have the specific components shown in the illustrations, embodiments of this disclosure are not limited to those particular combinations. It is possible to use some of the components or features from one of the examples in combination with features or components from another one of the examples.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. A portable case for an article comprising:

a case body establishing a cavity, the cavity dimensioned to at least partially receive an article;

an insert comprising a liquid dispersed memory foam received in the cavity wherein the insert includes a first layer comprising the liquid dispersed memory foam, and the insert includes a second layer disposed on the first layer, the second layer having a different material characteristic than the first layer, and the second layer extending along an external surface of the insert, and the second layer including an exposed face that is spaced apart from walls of the case body that establish the cavity; and wherein the insert includes a plurality of surface features establishing respective discontinuities along the face of the second layer, and the discontinuities cooperate to establish a graphic along the external surface of the insert that is visually distinct from the face of the second layer.

2. The portable case as recited in claim 1, wherein the case body includes a first case portion and a second case portion coupled to the first case portion at a hinge joint, and the first case portion and the second case portion are moveable between an open position and a closed position to enclose the cavity.

3. The portable case as recited in claim 2, further comprising a handle for carrying the portable case.

4. The portable case as recited in claim 2, wherein the case body establishes a groove that follows a perimeter of the first case portion, the groove is dimensioned to receive a seal member that establishes a sealing relationship between the first case portion and the second case portion, and the groove is dimensioned to encircle a wall of the case body establishing the cavity.

5. The portable case as recited in claim 1, wherein the article is a firearm.

6. The portable case as recited in claim 1, wherein the article is a photography device.

7. The portable case as recited in claim 1, wherein:

the surface features include a first surface feature and a second surface feature, the first surface feature is associated with a first color, the second surface feature is associated with a second color that differs from the first color, and the first and second colors differ from a color of surrounding portions of the face of the second layer.

8. The portable case as recited in claim 1, wherein the surface features include a first surface feature and a second surface feature that differs from the first surface feature in color and/or shade.

9. The portable case as recited in claim 8, wherein the first and second surface features comprise different pigments.

10. The portable case as recited in claim 1, wherein the second layer is dimensioned to space apart the surface features from the first layer.

11. The portable case as recited in claim 1, wherein the surface features protrude outwardly from the face of the second layer to establish the graphic.

12. The portable case as recited in claim 11, wherein the graphic establishes a third layer of the insert.

13. The portable case as recited in claim 11, wherein the graphic depicts at least one word, logo, shape, image or symbol.

14. The portable case as recited in claim 11, wherein the surface features are arranged in rows.

15. The portable case as recited in claim 7, wherein the first surface feature and the second surface feature are spaced apart from each other along the external surface of the insert.

16. The portable case as recited in claim 15, wherein the first and second surface features protrude outwardly from the face of the second layer to establish the graphic.

17. The portable case as recited in claim 1, wherein an impression of the article is established in the external surface of the insert in response to contact between the insert and the article.

18. The portable case as recited in claim 1, wherein the second layer and the surface features are monolithic.

* * * * *